US006649576B2

(12) United States Patent
Bell et al.

(10) Patent No.: US 6,649,576 B2
(45) Date of Patent: Nov. 18, 2003

(54) LUBRICATING OIL COMPOSITIONS

(75) Inventors: Ian A. W. Bell, Abingdon (GB); Robert Robson, Abingdon (GB)

(73) Assignee: Infineum International Inc. (GB)

( * ) Notice: Subject to any disclaimer, the term of this patent is extended or adjusted under 35 U.S.C. 154(b) by 0 days.

(21) Appl. No.: 10/163,210

(22) Filed: Jun. 5, 2002

(65) Prior Publication Data

US 2003/0022798 A1 Jan. 30, 2003

(30) Foreign Application Priority Data

Jun. 15, 2001 (EP) ..... 01305233

(51) Int. Cl.[7] ..... C10M 141/02

(52) U.S. Cl. ..... 508/481; 508/480; 508/482; 508/485

(58) Field of Search ..... 508/482, 485, 508/480, 481

(56) References Cited

U.S. PATENT DOCUMENTS

| | | | | | |
|---|---|---|---|---|---|
| 3,637,500 | A | * | 1/1972 | Forbes et al. | 508/482 |
| 4,960,542 | A | | 10/1990 | Seiki | 252/565 |
| 4,968,452 | A | | 11/1990 | Seiki | 252/56 S |
| 5,942,475 | A | * | 8/1999 | Schlosberg et al. | 508/492 |
| 5,994,278 | A | * | 11/1999 | Duncan et al. | 508/485 |
| 6,060,437 | A | * | 5/2000 | Robson et al. | 508/371 |
| 6,235,691 | B1 | * | 5/2001 | Boffa et al. | 508/482 |
| 6,444,624 | B1 | * | 9/2002 | Walker et al. | 508/363 |

FOREIGN PATENT DOCUMENTS

| | | | |
|---|---|---|---|
| EP | 0 552 554 A1 | 7/1993 | C10M/105/00 |
| EP | 0 931 827 A1 | 7/1999 | C10M/169/04 |

* cited by examiner

*Primary Examiner*—Jacqueline V. Howard

(57) ABSTRACT

A crankcase lubricant containing a Group III basestock in a major amount and a Group V basestock in the form of an ester in a minor amount. The lubricant also comprises a dispersant, a metal detergent, one or more other additives, and a viscosity modifier.

10 Claims, No Drawings

LUBRICATING OIL COMPOSITIONS

This invention relates to lubricating oil compositions such as multigrade lubricants that, in particular, give enhanced performance in diesel engine piston cleanliness and piston ring-sticking tests.

Lubricating oil compositions (or lubricants) for the crankcase of internal combustion engines are well-known and it is also well-known for them to contain additives (or additive components) to enhance their properties and performance.

Increasingly, the demands of original equipment manufacturers (OEM's) to meet performance criteria dictate the properties of lubricants. One such performance criterion concerns the sticking of piston rings during operation of a compression-ignited (diesel) internal combustion engine. This is usually referred to briefly as "ring-sticking"; it may be measured by the VWTDi test (CEC L-78-T-99). A second performance criterion that is measured in this test is piston cleanliness.

Other performance criteria of interest include the volatility of the lubricant, the fuel economy performance of the lubricant, and the chlorine content of the lubricant.

The various criteria clearly constrain formulators of lubricants in terms of additive components and amounts, and of basestocks, that may be used.

EP-A-1 087 008 describes a way of meeting "ring-sticking" test requirements by provision of certain additive components.

The present invention provides a different approach, i.e. by providing a specific basestock mixture in order to meet the above mentioned requirements.

In a first aspect, the invention is a crankcase lubricating oil composition, such as an SAE 5W-20, 5W-30 or 5W-40 composition, comprising, or made by admixing, a major amount of (A) a basestock of lubricating viscosity comprising a Group III basestock, in a major amount, and a Group V basestock, in the form of an ester, in a minor amount, such as 3 to 5, preferably 3 to 10, mass % based on the mass of the composition, other than basestocks that arise from provision of additive components in the composition; and minor amounts of lubricant additive components comprising (B) a dispersant, such as an ashless dispersant;

(C) a metal detergent;

(D) one or more other lubricant additive components selected from anti-oxidants, anti-wear agent and friction modifiers; and (E) a viscosity modifier.

The data contained in the specification demonstrate that the use of the basestock mixture (A) unexpectedly improves the performance of lubricating oil compositions in the TDi test.

In a second aspect, the invention is a method of lubricating a compression-ignited internal combustion engine comprising operating the engine and lubricating the engine with a lubricating oil composition according to the first aspect of the invention.

In a third aspect, the invention is a method of reducing the ring-sticking tendencies of a compression-ignited internal combustion engine comprising adding to the engine a lubricating oil composition according to the first aspect of the invention.

In a fourth aspect, the invention is a combination comprising the crankcase of a compression-ignited engine and a lubricating oil composition according to the first aspect of the invention for lubricating the crankcase.

In this specification:

"comprising" or any cognate word is taken to specify the presence of stated features, integers, steps or components, but does not preclude the presence or addition of one or more other features, integers, steps, components or groups thereof;

"major amount" means in excess of 50 mass % of the composition;

"minor amount" means less than 50 mass % of the composition both in respect of the stated additive and in respect of the total mass % of all of the additives present in the composition, reckoned as active ingredient of the additive or additives;

"oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The invention also provides the product obtained or obtainable as a result of any reaction between the various additive components of the composition or concentrates, essential as well as customary and optimal, under the conditions of formulation, storage or use:

The features of the invention will now be discussed in more detail as follows:

Multigrade Lubricants

Multigrade lubricants perform over wide temperature ranges. Typically, they are identified by descriptors such as SAE 10W-30 or SAE 5W-30. The first number in the multigrade descriptor is associated with a safe cranking temperature (e.g., −20° C.) viscosity requirement for that multigrade oil as measured by a cold cranking simulator (CCS) under high shear rates (ASTM D5293). In general, lubricants that have low CCS viscosities allow the engine to crank more easily at lower temperatures and thus improve the ability of the engine to start at those ambient temperatures.

Multiviscosity—grade oils, commonly referred to as "multigrades" are designed to operate over wide temperature ranges and are identified by descriptors such as SAE 10W-30 or SAE 5W-30,. Their properties are defined in the Society of Automotive Engineers document SAE J300. This publication defines multigrades in terms of two criteria:

Maximum low temperature cranking and pumping viscosities and

Maximum and minimum kinematic viscosities at 100° C. and a minimum high-shear viscosity at 150° C. and $10^8 s^{-1}$.

Low temperature properties define which "W" grade shall be assigned to a lubricant and high temperature properties define the "non W" part of the designation.

SAE J300 defines a series of W grades with SAE 0W representing the requirements for operation at lowest temperatures. SAE 5W, 10W, 15W, 20W and 25W are also defined, these grades are suitable for progressively higher minimum temperature of operation.

Non-W grades are also assigned a numerical designation, these define a scale of increasing high temperature viscosity. This scale starts with SAE 20 and goes through SAE 30, 40 and 50 to the most viscous grade, SAE 60.

This system of viscometric classification of automotive crankcase lubricants finds universal application with the vehicle and lubricant manufacturing industries.

(A) Basestock

The basestock (sometimes referred to as "base oil") is an oil of lubricating viscosity and is the primary liquid constituent of a lubricant into which additives and possibly other oils are blended to produce the final lubricant.

Basestocks may be categorised in Groups I to V according to the API Engine Oil Licensing and Certification System (EOLCS) API 1509 definitions, which definitions are used to define the basestocks of this invention. Thus:

a) Group I basestocks contain less than 90 percent saturates and/or greater than 0.03 percent sulfur and have a viscosity index greater than or equal to 80 and less than 120 using the test methods specified in Table E-1.

b) Group II basestocks contain greater than or equal to 90 percent saturates and less than or equal to 0.03 percent sulfur and have a viscosity index greater than or equal to 80 and less than 120 using the test methods specified in Table E-1.

c) Group III basestocks contain greater than or equal to 90 percent saturates and less than or equal to 0.03 percent sulfur and have a viscosity index greater than or equal to 120 using the test methods specified in Table E-1.

d) Group IV basestocks are polyalphaolefins (PAO).

e) Group V basestocks include all other basestocks not included in Group I, II, III, or IV.

As stated, the basestock (A) in the present invention comprises a major amount of a Group III basestock and a minor amount of Group V basestock in the form of an ester. Preferably, it consists essentially of such basestocks, but may contain minor amounts of Group I or Group II basestocks or both. Group III basestocks are commercially available.

Group V basestocks in the form of esters are also commercially available. Examples include polyol esters such as pentaerythritol esters, trimethylolpropane esters and neopentylglycol esters; diesters; $C_{36}$ dimer acid esters; trimellitate esters, i.e. 1,2,4-benzene tricarboxylates; and pathalate esters, i.e. 1,2-benzene dicarboxylates. The acids from which the esters are made are preferably monocarboxylic acids of the formula $RCO_2H$ where R represents a branched, linear or mixed alkyl group. Such acids may, for example contain 6 to 18 carbon atoms.

(B) Dispersants

Dispersants, such as ashless dispersants i.e. non-metallic organic materials that form substantially no ash on combustio, hold solid and liquid contaminants in suspension and comprise long-chain hydrocarbons, to confer oil-solubility, with a polar head capable of associating with particles to be dispersed. A noteworthy group is hydrocarbon-substituted succinimides.

(C) Metal Detergents

A detergent is an additive that reduces formation of piston deposits, for example high temperature varnish and lacquer deposits, in engines; it normally has acid-neutralising properties and is capable of keeping finely-divided solids in suspension. Most detergents are based on metal "soaps", that is metal surfactants or salts of acidic organic compounds.

Detergents generally comprise a polar head with a long hydrophobic tail, the polar head comprising a metal salt of an acidic organic compound. The salts may contain a substantially stoichiometric amount of the metal, in which case they are usually described as normal or neutral salts, and would typically have a total base number or TBN (as may be measured by ASTM D2896) of from 0 to 80. Large amounts of a metal base can be included by reacting an excess of a metal compound, such as an oxide or hydroxide, with an acidic gas such as carbon dioxide. The resulting overbased detergent comprises neutralised detergent as the outer layer of a metal base (e.g. carbonate) micelle. Such overbased detergents may have a TBN of 150 or greater, and typically of from 250 to 450 or more.

The detergents that may be used include oil-soluble neutral and overbased sulfonates, phenates, sulfurized phenates, thiophosphonates, salicylates, and naphthenates. Particularly convenient detergents are neutral and overbased calcium sulfonates having a TBN of from 20 to 450 TBN, and neutral and overbased calcium phenates and sulfurized phenates having a TBN of from 50 to 450.

(D) Other Lubricant Additives anti-oxidants increase the composition's resistance to oxidation and may work by combining with and modifying peroxides to render them harmless by decomposing peroxides or by rendering an oxidation catalyst inert. They may be classified as radical scavengers (eg sterically hindered phenols, secondary aromatic amines, and organo-copper salts); hydroperoxide decomposers (eg organo-sulfur and organophosphorus additives); and multifunctionals. In the practice of the present invention, the use or otherwise of certain anti-oxidants may confer certain benefits. For example, in one embodiment it may be preferred that the lubricating oil composition is free of any secondary aromatic amine anti-oxidants. In another embodiment, it may be preferred to employ in the lubricating oil composition a combination of one or more secondary aromatic amine anti-oxidants (eg in the range of 0.1 to 0.7, preferably 0.2 to 0.5, mass % of the composition) and one or more sterically hindered phenol anti-oxidants (eg in the range of 0.1 to 2, preferably 0.5 to 1.5 mass % of the composition); such composition may for example contain one or more molybdenum-containing additives in an amount providing from 50 or 100 to 500 or 700 ppm by mass of elemental molybdenum in the composition.

anti-wear agents reduce friction and excessible wear and are usually based on compounds containing sulfur or phosporus or both. Noteworthy are metal dihydrocarbyl dithiophosphates such as zinc dialkyl dithiophosphates (ZDDP's). Preferably, the alkyl groups are essentially secondary alkyl groups.

friction modifiers include boundary additives that lower friction coefficients and hence improve fuel economy. Examples are esters of polyhydric alcohols such as glycerol monoesters of higher fatty acids, for example glycerol mono-oleate; esters of long chain polycarboxylic acids with diols, for example the butane diol esters of dimerized unsaturated fatty acids; oxazoline compounds; and alkoxylated alkyl-substituted mono-amines, and alkyl ether amines, for example, ethoxylated tallow amine and ethoxylated tallow ether amine. Preferably, in the practice of this invention, component(s) (D) includes one or more friction modifiers selected from esters of polyhydric alcohols and from alkoxylated amines.

(E) Viscosity Modifiers

Viscosity modifiers (or viscosity index improvers) impart high and low temperature operability to a lubricating oil. Viscosity modifiers that also function as dispersants are also known and may be prepared as described above for ashless dispersants. In general, these so-called dispersant viscosity modifiers are functionalized polymers (e.g. interpolymers of ethylene-propylene post-grafted with an active monomer such as maleic anhydride) which are then derivatized with, for example, an alcohol or amine.

Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

Representative examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, interpolymers of styrene and acrylic esters, and partially hydrogenated copolymers of styrene, isoprene, styrene/butadiene, and isoprene/butadiene, as well as the partially hydrogenated homopolymers of butadiene and isoprene and isoprene/divinylbenzene.

Other known additives may be incorporated into the lubricating oil compositions of the invention, being different from those defined in the invention. They may, for example, include other detergents; rust inhibitors; corrosion inhibitors; pour point depressants; anti-foaming agents; and surfactants. They can be combined in proportions known in the art.

As is known in the art, some additives can provide a multiplicity of effects; thus, for example, a single additive may act both as a dispersant and as an anti-oxidant.

Concentrates

In the preparation of lubricating oil compositions, it is common practice to introduce additive(s) therefor in the form of concentrates of the additive(s) in a suitable oleaginous, typically hydrocarbon, carrier fluid, e.g. mineral lubricating oil, or other suitable solvent. Oils of lubricating viscosity such as described herein, as well as aliphatic, naphthenic, and aromatic hydrocarbons, are examples of suitable carrier fluids for concentrates.

Concentrates constitute a convenient means of handling additives before their use, as well as facilitating solution or dispersion of additive in lubricating oil compositions. When preparing a lubricating oil composition that contains more than one type of additive, each additive may be incorporated separately—each in the form of a concentrate. In many instances, however, it is convenient to provide a so-called additive "package" (also referred to as an "adpack") comprising two or more additives in a single concentrate.

A concentrate may contain 1 to 90, such as 10 to 80, preferably 20 to 80, more preferably 20 to 70, mass % active ingredient of the additive or additives.

Making Compositions

Lubricating oil compositions may be prepared by adding to an oil of lubricating viscosity a mixture of an effective minor amount of at least one additive and, if necessary, one or more co-additives such as described hereinafter. This preparation may be accomplished by adding the additive directly to the oil or by adding it in the form of a concentrate thereof to disperse or dissolve the additive. Additives may be added to the oil by any method known to those skilled in the art, either prior to, contemporaneously with, or subsequent to addition of other additives.

The lubricating oil compositions may be used to lubricate mechanical engine components, particularly an internal combustion, such as a compression-ignited engine, by adding the lubricating oil thereto. Particular examples of compression-ignited engine are those developed in recent years where the top ring groove temperature may exceed 150° C. due to increases in specific power output to around 40 kW/liter or greater. These engines are more prone to suffer from ring-sticking problems in their operation.

When concentrates are used to make the lubricating oil compositions, they may for example be diluted with 3 to 100, e.g. 5 to 40, parts by mass of oil of lubricating viscosity per part of the concentrate.

When lubricating oil compositions contain one or more additives, each additive is typically blended into the base oil in an amount which enables the additive to provide its desired function. Representative effective amounts of such additives, when used in crankcase lubricants, are listed below. All the values listed herein are stated as mass percent active ingredient, unless otherwise indicated.

| ADDITIVE | MASS % (Broad) | MASS % (Preferred) |
|---|---|---|
| Ashless Dispersant | 0.1–20 | 1–8 |
| Metal detergents | 0.1–6 | 0.2–4 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier | 0.01–6 | 0–4 |
| Mineral or Synthetic Base Oil | Balance | Balance |

The final composition may contain from 5 to 25, preferably 5 to 18, typically 10 to 15, mass % of the concentrate, the remainder being oil of lubricating viscosity.

EXAMPLES

The invention will now be particularly described, by way of example only, as follows:

Preparation of Lubricating Oil Compositions

Two lubricating oil compositions (or oils) were prepared, by methods known in the art, by blending an additive package, a basestock mixture, and a viscosity modifier. In the two oils, the additive package and the viscosity modifiers were the same and were present in the same proportions, expressed as mass %. The basestock mixture was different such that one of the oils (Oil A) was a comparision oil, and the other oil (Oil 1) was an oil of the invention.

The formulations of Oils A and 1 are set out below where all figures represent mass % based on the total mass of the oil

| | Oil A | Oil B |
|---|---|---|
| Additive Package | 13.8 | 13.8 |
| Group III basestock (commercially available) | 77.1 | 72.3 |
| Group V basestock (a trimethyolopropane (TMP) ester with C8-C10 alkyl chains) | — | 10.0 |
| Group 1 basestock | 5.2 | — |
| Viscosity Modifier | 3.9 | 3.9 |

Tests and Results

Samples of each of Oils A and 1 were subjected to an engine test used to investigate deposit formation, based specifically on the VWTDi CEC-L-78-T-99 test, also known as the PV1452 test. The test is regarded as an industry standard and as a severe assessment of a lubricant's performance capabilities.

The test employs a 4 cylinder 1.9 liter 81 kW passenger car diesel engine. It is a direct injection engine, with a turbocharger system used to increase the power output of the unit. The industry test procedure consists of a repeating cycle of hot and cold running conditions—the so called PK cycle. This involves a 30 minute idle period at zero followed by 180 minutes at full load and 4150 rpm. The entire cycle is then repeated for a total of 54 hours. In this 54 hour period the initial oil fill of 4.5 liters of test lubricant is not topped up.

At the end of the 54 hour test, the engine is drained, the engine disassembled and the pistons rated for piston deposits and piston ring sticking. This affords a result which is assessed relative to an industry reference oil (RL206) to define passing or failing performance.

The pistons are rated against what is known as the DIN rating system. The three piston-ring grooves and the two piston lands that lie between the grooves are rated on a merit scale for deposits and given a score out of 100—the higher the number the better; 100 indicates totally clean and 0 indicates totally covered with deposit. The five scores are then averaged to give the overall piston cleanliness merit rating. The scores for each of the four pistons are then averaged to afford the overall piston cleanliness for the test.

The rings are also assessed for ring sticking, which can occur due to excessive deposit build up in the grooves. This is reported as an average over the rings on all the pistons, and also the maximum ring sticking observed across the four pistons.

As indicated, these results are judged relative to an industry reference oil (RL206) to define passing performance.

In the test employed in this study, to obtain intermediate piston ratings, the engine was stopped every 12 hours, drained, stripped and rated, and re-assembled; the original test oil was put back into the engine which was then restarted.

The results obtained are tabulated below:

Average Piston Cleanliness (merits)

| | Inspection time (hours) | | | | |
|---|---|---|---|---|---|
| | 12 | 24 | 36 | 48 | 60 |
| Oil A | 69 | 65 | 63 | — | — |
| Oil 1 | 75 | 74 | 74 | 72 | 59 |

The results demonstrate that Oil 1 exhibits superior performance to Oil A.

What is claimed is:

1. A crankcase lubricating oil composition comprising, or made by admixing, a major amount of (A) a basestock of lubricating viscosity comprising a Group III basestock, in a major amount, and a Group V basestock, in the form of a polyol ester, in a minor amount, other than basestocks that arise from provision of additive components in the composition; and minor amounts of lubricant additive components comprising (B) a dispersant;

(C) a metal detergent;

(D) one or more other lubricant additive components selected from anti-oxidants, anti-wear agent and friction modifiers; and (E) a viscosity modifier.

2. The composition as claimed in claim 1 wherein the basestock (A) consists essentially of the Group III basestock and the Group V basestock.

3. A method of lubricating a compression-ignited internal combustion engine comprising operating the engine and lubricating the engine with a lubricating oil composition as claimed in claim 1.

4. A method of reducing the ring-sticking tendencies and improving piston cleanliness of a compression-ignited internal combustion engine comprising adding to the engine a lubricating oil composition as claimed in claim 1.

5. The crankcase of a compression-ignited internal combustion engine, lubricated with a lubricating oil composition as claimed in claim 1.

6. The composition as claimed in claim 1, wherein said Group V basestock comprises 0.5 to 15 mass %, based on the total mass of basestock.

7. The composition as claimed in claim 6, wherein said Group V basestock comprises 3 to 10 mass %, based on the total mass of basestock.

8. The composition as claimed in claim 7, wherein said Group V basestock comprises 5 to 8 mass %, based on the total mass of basestock.

9. The composition as claimed in claim 1, wherein said polyol ester is selected from the group consisting of pentaerythritol esters, trimethylolpropane esters and neopentylglycol esters; diesters; $C_{36}$ dimer acid esters; trimellitate esters and phthalate esters, i.e. 1,2-benzene dicarboxylates.

10. The composition as claimed in claim 9, wherein the acids from which the esters are made are monocarboxylic acids of the formula $RCO_2H$ wherein R represents a branched, linear or mixed alkyl group containing 6 to 18 carbon atoms.

* * * * *